US008214934B2

(12) United States Patent
Sullivan

(10) Patent No.: US 8,214,934 B2
(45) Date of Patent: Jul. 10, 2012

(54) SEAMLESS SINK DRAIN ASSEMBLY WITH DISPOSER/STRAINER MOUNTING SYSTEM

(75) Inventor: Daniel O Sullivan, Cincinnati, OH (US)

(73) Assignee: Seamless Sink LLC, Cincinnati, OH (US)

( * ) Notice: Subject to any disclaimer, the term of this patent is extended or adjusted under 35 U.S.C. 154(b) by 333 days.

(21) Appl. No.: 12/524,564

(22) PCT Filed: Jan. 24, 2008

(86) PCT No.: PCT/US2008/000951

§ 371 (c)(1), (2), (4) Date: Jul. 24, 2009

(87) PCT Pub. No.: WO2008/091676

PCT Pub. Date: Jul. 31, 2008

(65) Prior Publication Data

US 2010/0095444 A1 Apr. 22, 2010

Related U.S. Application Data

(60) Provisional application No. 60/886,392, filed on Jan. 24, 2007.

(51) Int. Cl.
*A47K 1/14* (2006.01)

(52) U.S. Cl. ..... 4/287

(58) Field of Classification Search ..... 4/287–295, 4/679; 241/46.013

See application file for complete search history.

(56) References Cited

U.S. PATENT DOCUMENTS 4,232,407 A * 11/1980 Williams ..... 4/287
5,318,230 A * 6/1994 Ferguson et al. ..... 241/46.13

* cited by examiner

*Primary Examiner* — Lori Baker
(74) *Attorney, Agent, or Firm* — Wm. Cates Rambo

(57) ABSTRACT

The sink drain assembly (3-5) comprises a downwardly extending drain sleeve (3) integrally formed on the sink (1); a resilient, generally cylindrical mounting member (5) formed with an upper annular section (7) adapted to releasably engage the drain sleeve (3) and with a lower annular section (13) adapted to releasably receive an upper portion (12) of a garbage disposer (8,9); a clamp (14) removably attachable to the mounting member (5) in overlying relation to the upper (7) and lower (13) annular sections, and a strainer (64) having a radially outwardly extending gasket (63) adapted to establish a generally water tight seal between the strainer (64) and a splashguard (66) mounted on the upper portion (12) of the garbage disposer (8,9).

11 Claims, 8 Drawing Sheets

SEAMLESS SINK DRAIN ASSEMBLY WITH DISPOSER/STRAINER MOUNTING SYSTEM

RELATED APPLICATION

The present international application is related to U.S. Provisional Application No. 60/886,392 filed Jan. 24, 2007 in the name of the above-identified inventor.

TECHNICAL FIELD

The exemplary embodiment relates to sink drain assemblies, and more particularly to those adapted to receive a garbage disposer and a strainer.

BACKGROUND ART

The present inventor was struck by the complexity, hardware, tools and caulking needed to install a kitchen sink disposer bracket and sink strainer drain assembly. Also, the four main disposer bracket assemblies were incompatible with each other. The flange on top of the sink bottom collected water, debris, bacteria, fungi and sometimes rusted. The seam left an ugly seam which leaked if not installed properly. The time and inconvenience involved in the install was considerable and expensive. Also, the strainer baskets would not seal the various disposer splashguards. This necessitated a separate plug and sometimes allowed unwanted debris to enter the disposer. This was especially a hindrance on single bowl sinks. The present inventor set out to develop a seamless sink with an integrated universal disposer/strainer mounting system (seamless sink) that eliminated these concerns.

SUMMARY OF THE INVENTION

A sink drain assembly according to an exemplary embodiment of the present invention is connectable to a lip disposed on either a garbage disposer or a strainer base member. The sink drain assembly basically comprises a sink having an opening in its bottom defined by a generally cylindrical drain sleeve. The drain sleeve is integrally formed from and continuous with the bottom and has a flange adjacent to its outer end. A resilient mounting member has a generally cylindrical interior surface formed with spaced apart upper and lower channels. The mounting member removably receives the drain sleeve flange in the upper channel and the lip on the garbage disposer or the strainer base member in the lower channel. A clamp is removably attached to the mounting member in overlying relation to the upper and lower channels to secure the mounting member to the drain sleeve and to either the garbage disposer or the strainer base member.

DETAILED DESCRIPTION OF THE EXEMPLARY EMBODIMENT

Figure 1:
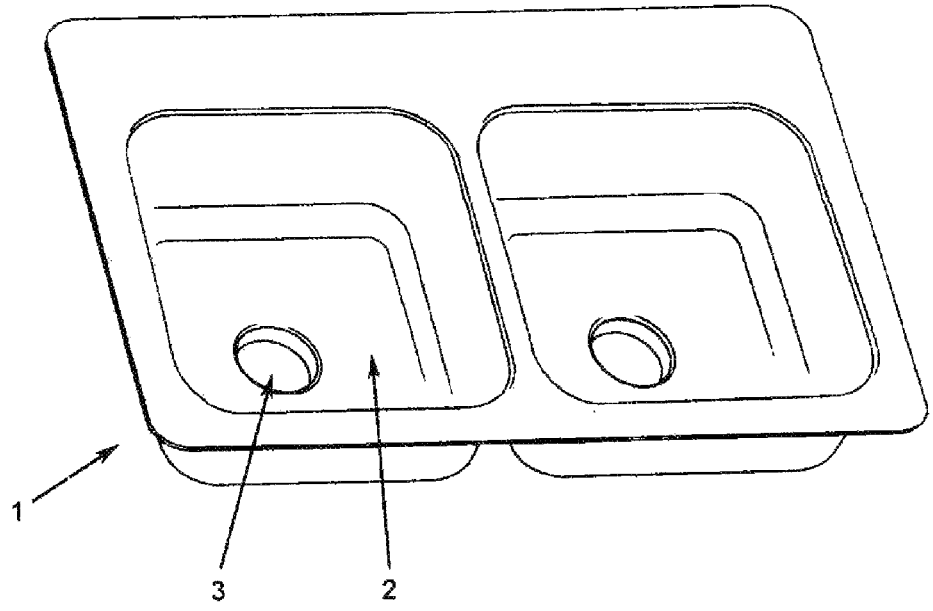
FIG. 1 is a downward perspective view of the seamless sink.
Figure 10:
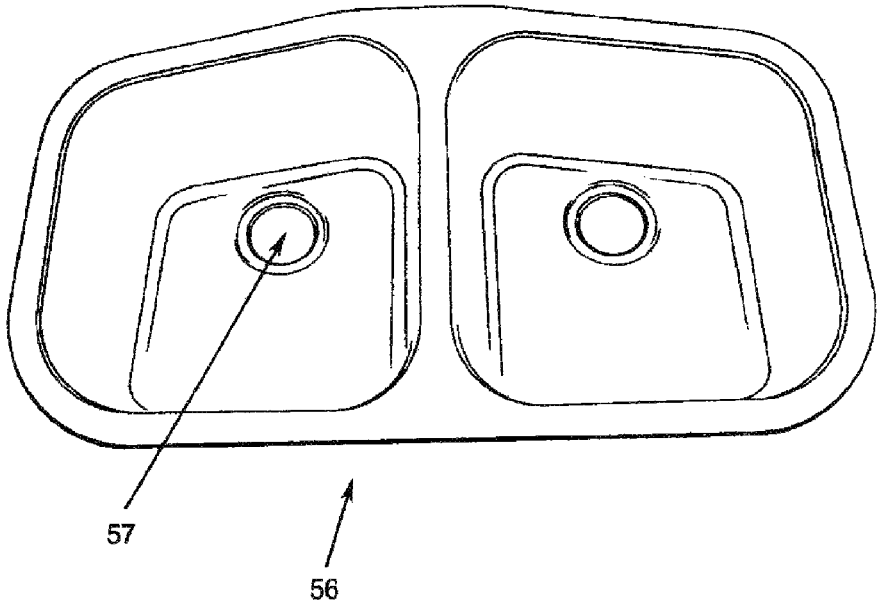
Figure 10 Prior Art
FIG. 10 is a photographic view of a prior art sink.

Conventional kitchen sinks 56 FIG. 10 have a hole 57 FIG. 10 punched in the bottom to accept plumbing accessories. These accessories include waste disposer brackets and sink strainer drain assemblies. The Seamless Sink 1 FIG. 1, 2 does not have a hole 57 punched in the bottom 2 FIG. 1, 2 of the sink 1, instead the steel is used to form a continuous downward extending sleeve 3 FIG. 1, 2, 3. Drain water flows smoothly through this seamless sink sleeve 3 into the strainer assembly or disposer.

Figure 2:
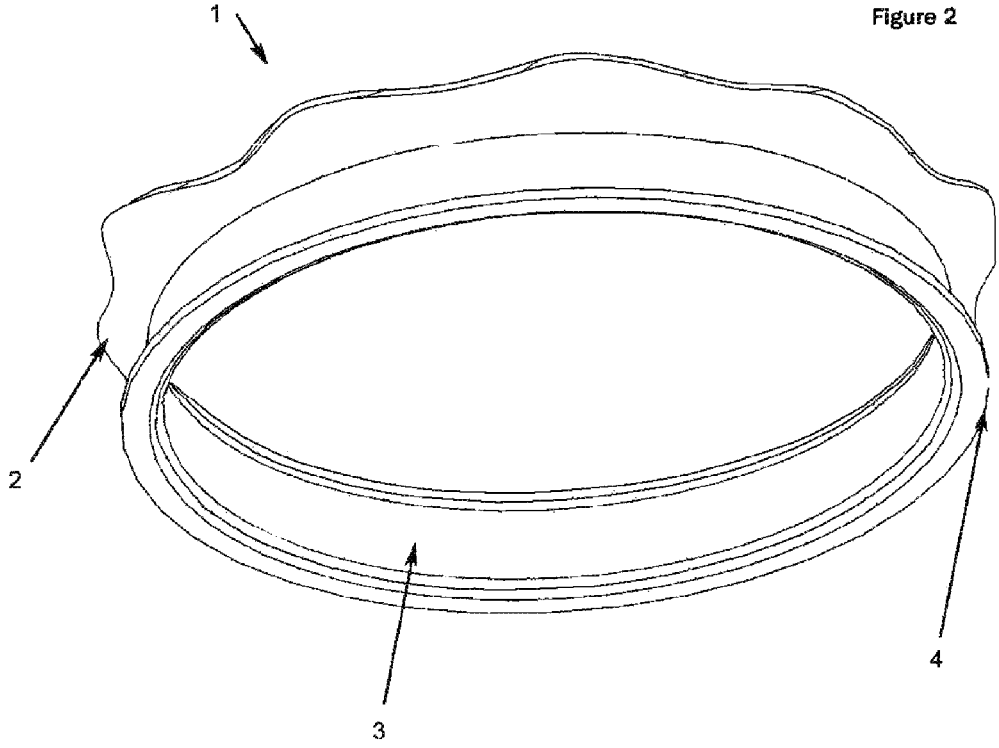
FIG. 2 is a side perspective view of the downturned sink sleeve.
Figure 3:
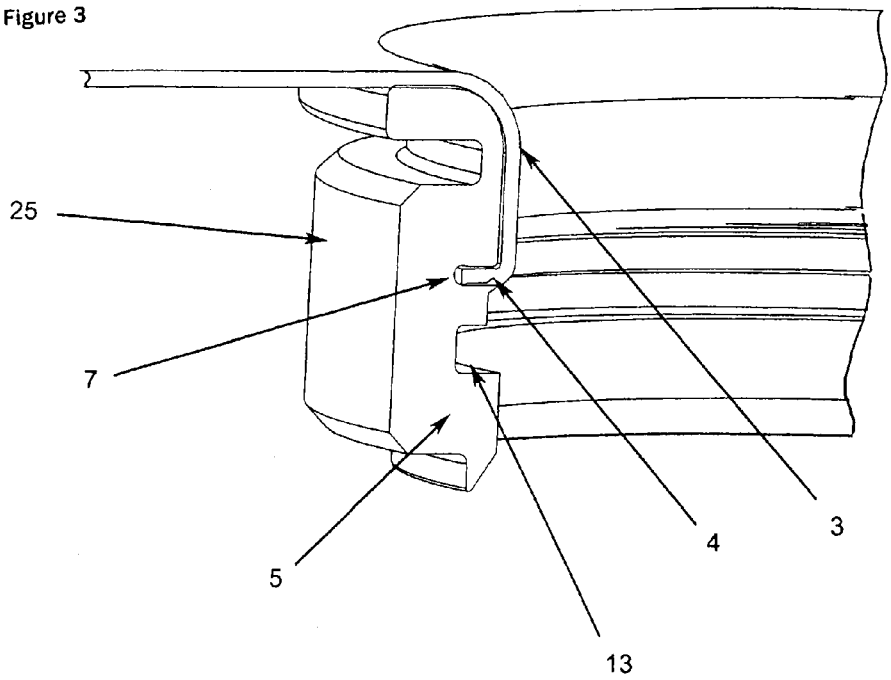
FIG. 3 is a side sectional view of the downturned sink and mounting seal.

The bottom of the sink sleeve 3 has a small outward extending flange (Flange) 4 FIG. 2, 3, 5 which is used to attach the sink's universal disposer and strainer mounting seal 5 FIG. 3, 5 (mounting seal). The flange 4 provides a ledge for the sink's mounting seal 5 to grab. The sink's flange 4 may be any angle, but a simple ninety degree flare is pictured and preferred. The sleeve 3 and flange 4 may descend any distance from the sink. The sink's mounting seal 5 may also be attached to the sink sleeve 3 by employing inwardly or outwardly protruding channels, dimples or contours, rims etc. The seamless sink's mounting seal 5 may be made of rubber, silicone, urethane or any other strong flexible material.

The mounting seal 5 has a thin indent (flange indent) 7 FIG. 3 that accepts the flange 4. The mounting seal 5 is attached to the flange 4 by firmly pressing the flexible mounting seal's 5 flange indent 7 onto the flange 4. The mounting seals 5 may be attached to one or more sink sleeves 3 on the sink 1.

Figure 4:
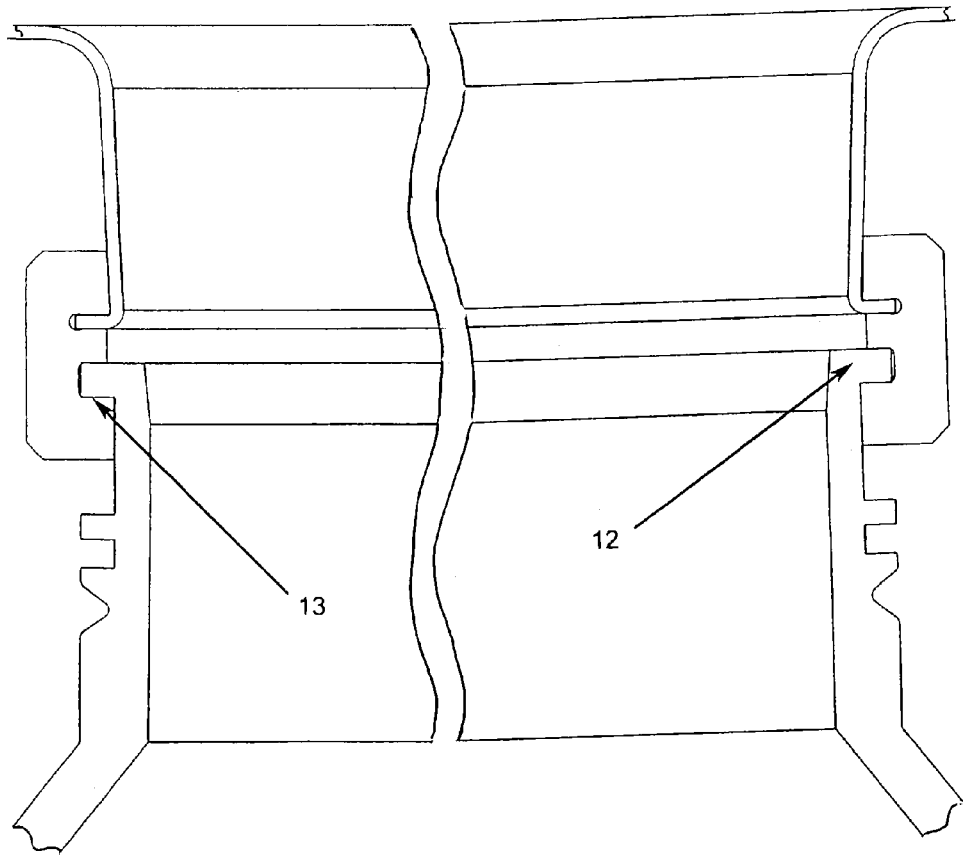
FIG. 4 is a side sectional view of the sink downturn, mounting seal and disposer lip.
Figure 6:
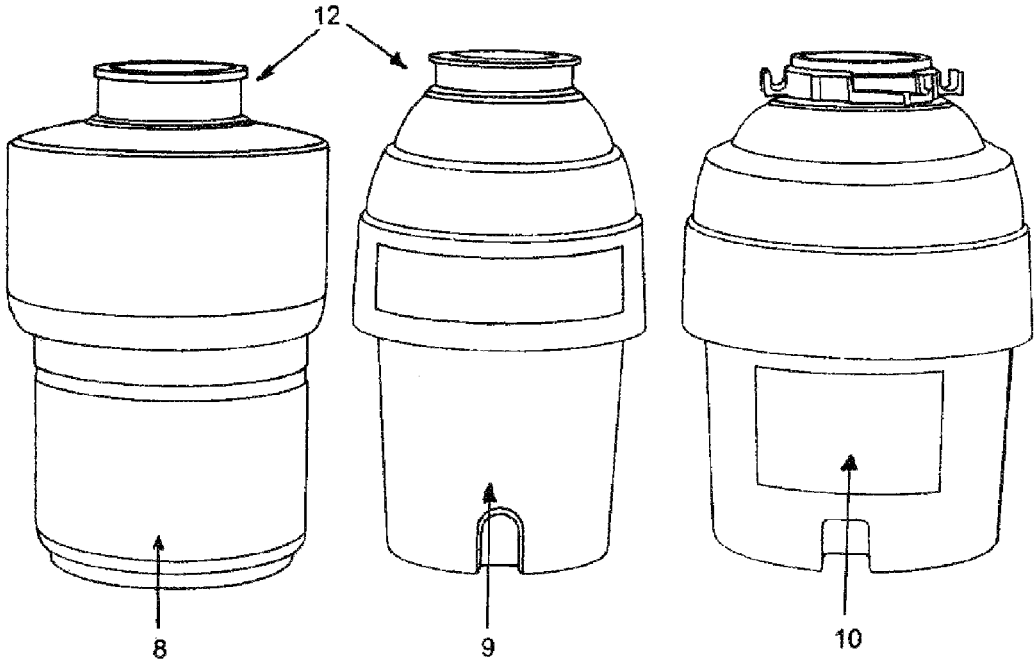
Figure 6 Prior Art
FIG. 6 is a photographic side view of three common disposers.

When a typical residential kitchen waste disposer (disposer) 8, 9 FIG. 6 has the mounting hardware removed, a lip 12 FIG. 4, 6 on the top of the disposer 8,9 remains. Most disposer tops have almost identical outwardly protruding lips 12 FIG. 4, 6. The Waste King Nub Type Disposer 10 FIG. 6 uses an adapter to provide an identical lip (disposer lip). The disposer lip 12 is inserted into the inward facing rim indent 13 FIG. 3, 4 of the mounting seal 5.

Figure 7:
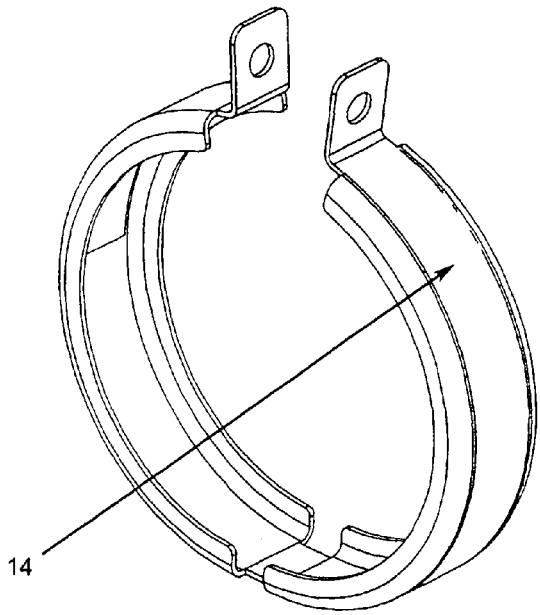
FIG. 7 is a side perspective view of the mounting clamp.
Figure 15:
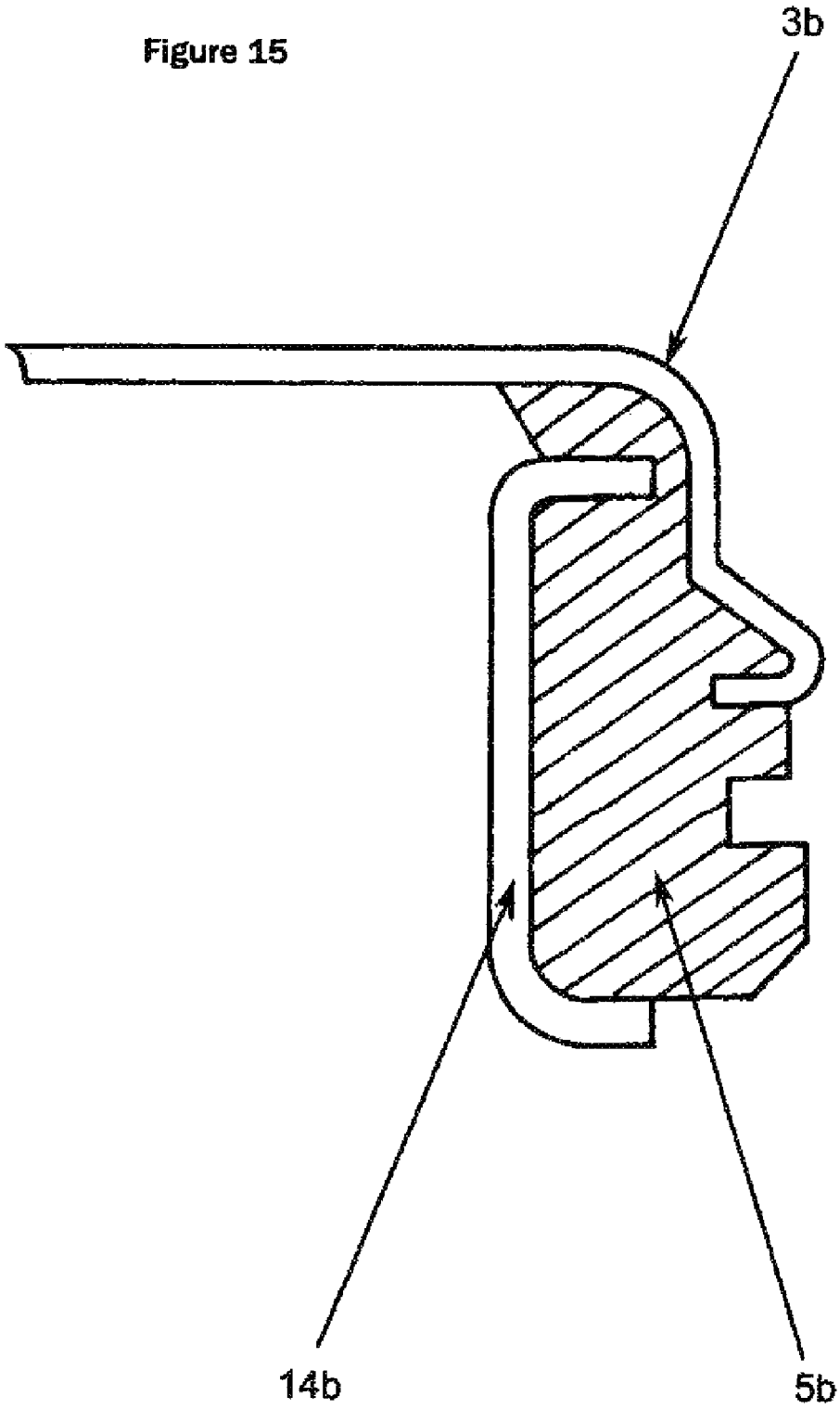
FIG. 15 is a side sectional view of an alternative seamless sink design for attaching the mounting seal.

The disposer lip 12 is secured by tightening a "C" clamp 14 (clamp) FIG. 7 into the outside wall 25 FIG. 3 of the mounting seal 5. The clamp 14 may have a stop so it cannot be over tightened and it can be made of stamped or cast metal, a durable plastic, nylon, resin, etc. The clamp may be tightened using bolts, screws, levers, clasps, over under clasps, or any mechanism capable of tightening the clamp. The mounting clamp 14 may employ contours and edges to facilitate compressing and stability. The mounting seal 5, sink sleeve 3 and disposer lip 12 may be secured in a variety of ways, these include threaded compression fittings , V-clamps, "C" clamps, plates that bolt or screw together, lever clamps, lever "C" clamps, etc. An alternative method of attaching the seamless sink mounting seal 5*b* is shown in FIG. 15. The mounting seal 5*b* FIG. 15 protrudes into an indent on the sink sleeve 3*b*

FIG. 15 and is secured with the clamp 14*b* FIG. 15. With minor modifications, a manufacturer may decide to permanently attach a mounting seal 5 onto all the sink sleeves for convenience and simplicity and to protect the flange 4. Glues, epoxies, clamps, straps etc may be used to permanently attach the mounting seal to the sink sleeve 3.

Figure 5:
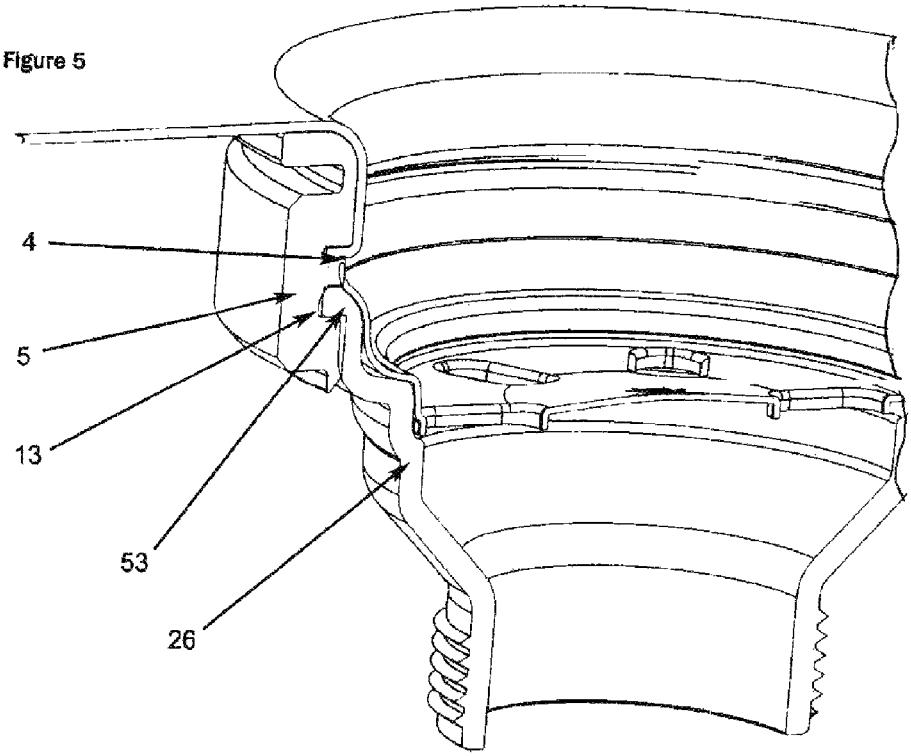
FIG. 5 is a side sectional view of the downturned sink, mounting seal and strainer bottom.

A strainer bottom 26 FIG. 5 may be attached to one or more sink sleeves 3. The strainer bottom's 26 lip 53 FIG. 5 is fitted into the mounting seal 5 flange indent 13 FIG. 5. The strainer bottom 26 may be secured in the mounting seal 5 with the same type clamp 14 as the disposer lip 12. It may also be secured in a variety of ways, these include threaded compression fittings, V-clamps, plates that bolt or screw together, etc. The strainer bottom lip 53 may have angles other than 90 degrees and may have a thin washer or rubber sealant applied to it to prevent leaks.

Figure 8:
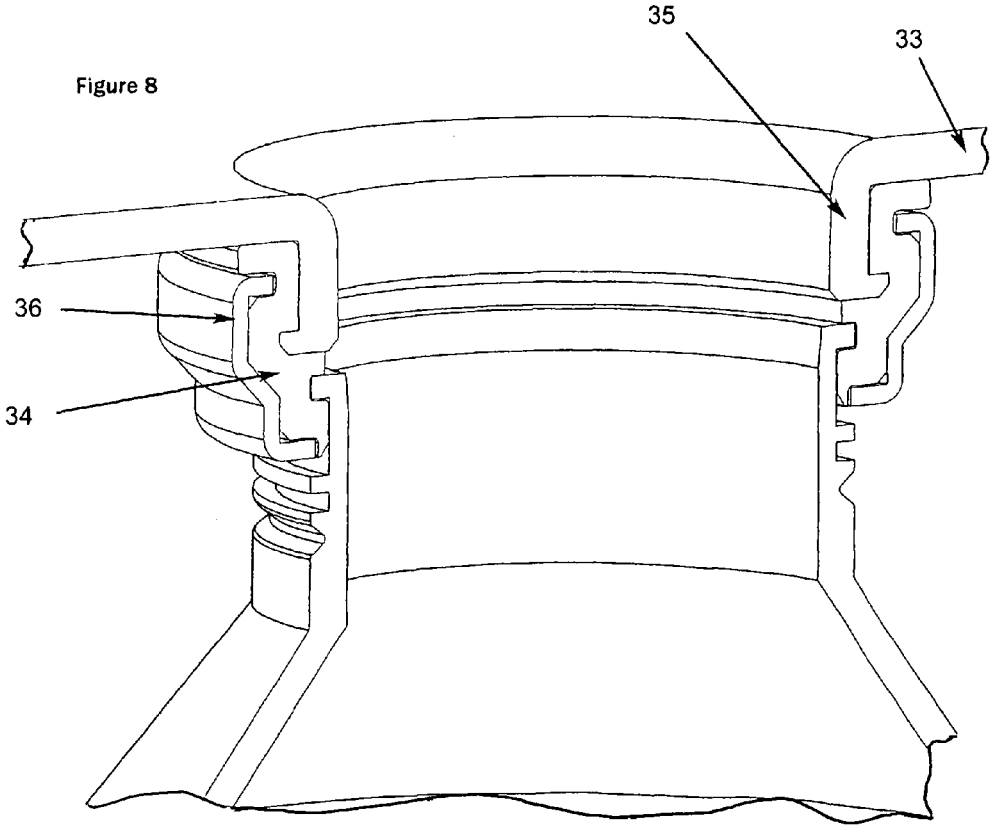
FIG. 8 is a side sectional view of a seamless solid surface sink, mounting seal, mounting clamp and disposer.
Figure 9:
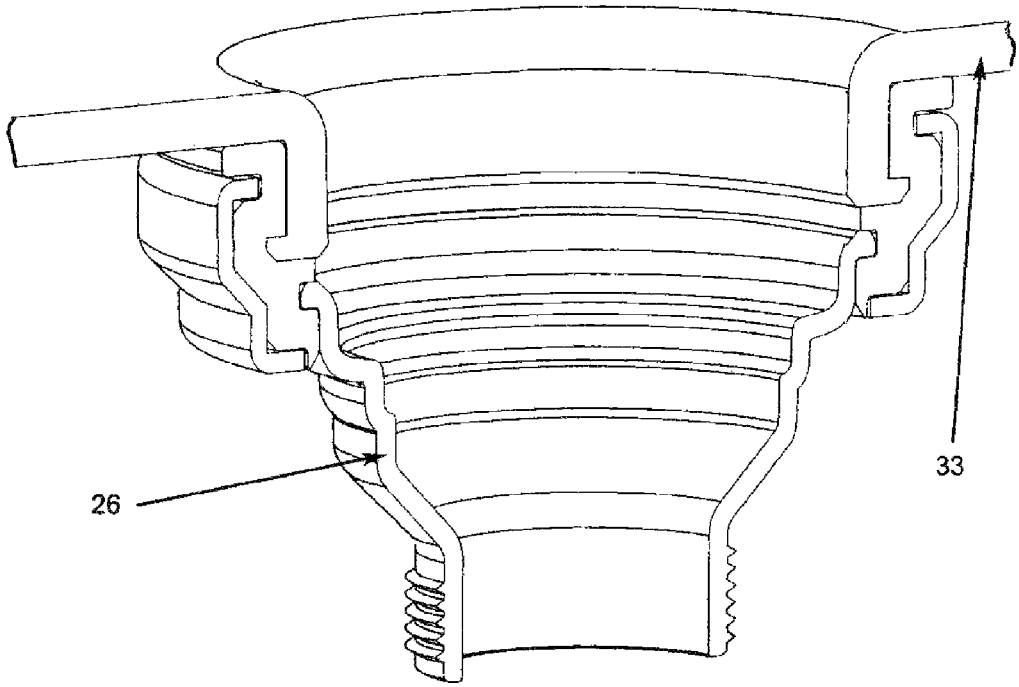
FIG. 9 is a side sectional view of a seamless solid surface sink, mounting seal, mounting clamp and strainer bottom.

A thicker seamless sink such as solid surface, acrylic, granite composite, cast iron, etc. 33 FIG. 8, 9 (acrylic sink) may employ this same method of attaching the disposer lip 12 and strainer bottom 26 to itself 33. A slight adjustment to the acrylic sink's 33 mounting seal 34 FIG. 8, 9 (acrylic mounting seal) adjusts for the thicker sleeve walls 35 FIG. 8. A clamp 36 FIG. 8, 9 may also be used to secure and compress the acrylic mounting seal 34 and prevent leaks. The strainer bottom 26 FIG. 9 is installed as before. The acrylic sink's 33 mounting seal 34 fits the majority of disposers and the stamped, cast or machined strainer bottom 26. Other couplings, such as v-clamps, compression fittings, seals and fittings permanently attached to the acrylic sink 33 to facilitate coupling, etc. may be employed to secure the acrylic mounting seal 34 and disposer lip 12 and strainer bottom 26.

Figure 11:
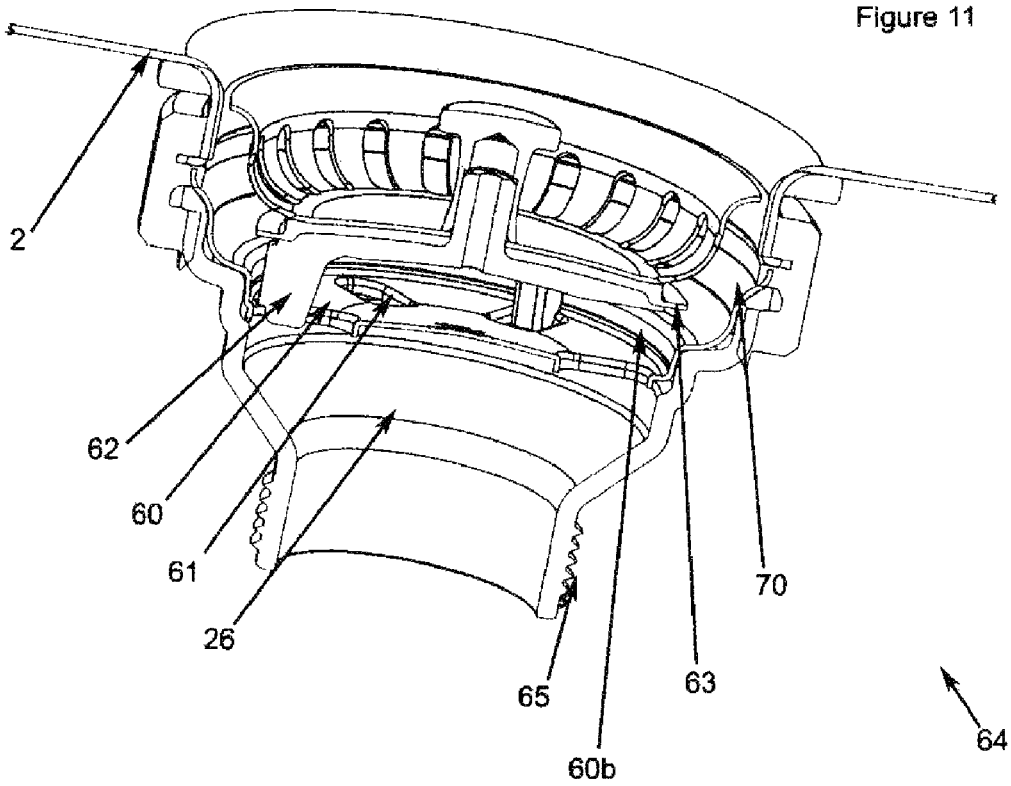
FIG. 11 is a side sectional view of a seamless sink, integrated strainer basket and strainer basket bottom.

A conventional strainer basket has a seal that plugs the approximately 1.5 inch indent in the bottom of the strainer cup that leads to the drain plumbing. This conventional strainer basket seal is not intended or coordinated to seal the opposite side of the sink where the disposer splashguard is. The seamless sink strainer assembly 64 FIG. 11 is designed to seal both the strainer basket cup 60 FIG. 11, 13 and the disposer splashguard 66 FIG. 12, 14. The seamless sink strainer assembly 64 utilizes an oversized seal 63 FIG. 11, 12. This oversized seal 63 seats into an oversized, matching strainer cup seat 60*b* FIG. 11 and splashguard indented seat 69 FIG. 12 for a watertight seal. The strainer cup 60 has holes 61 FIG. 11, 13 that allow water to drain. Every other hole 61 is larger allowing the three plastic legs 62 FIG. 11 to descend through them, allowing an oversized seal 63 FIG. 11 to engage against the oversized strainer cup seat 60*b* FIG. 11, 13 to fill the sink. The strainer assembly 64 may be cast or molded in one piece out of plastic, acrylic, steel, iron, zinc, any metal or any hard castable material or machined from any rigid material. This strainer assembly 64 may be made of stamped stainless steel and brazed together. It may also be a combination of any material. The threads 65 FIG. 11 can be brazed on as well or cut or rolled into it.

Figure 12:
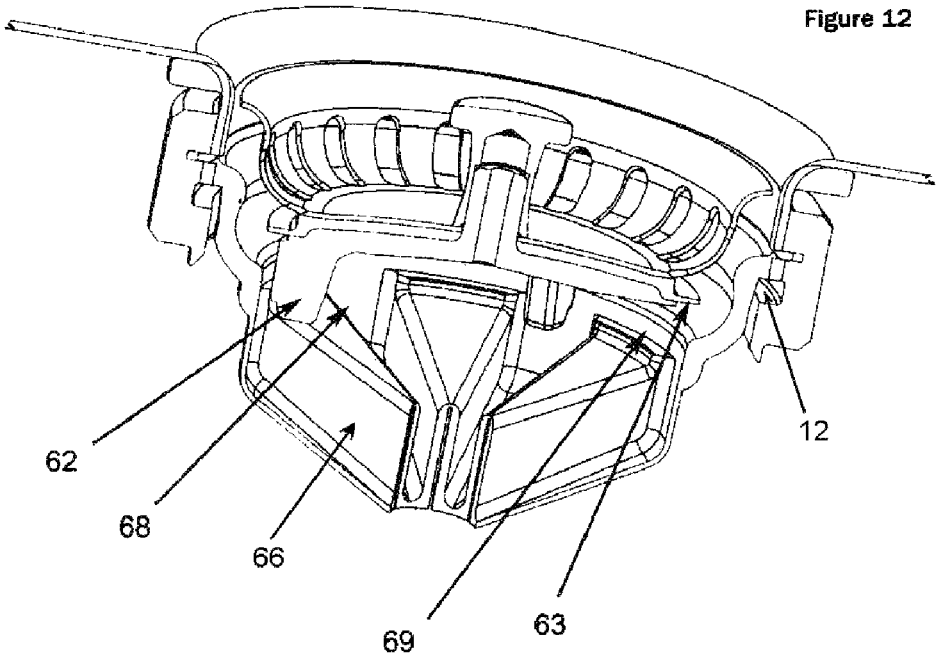
FIG. 12 is a side sectional view of a seamless sink, integrated strainer basket and splashguard.
Figure 13:
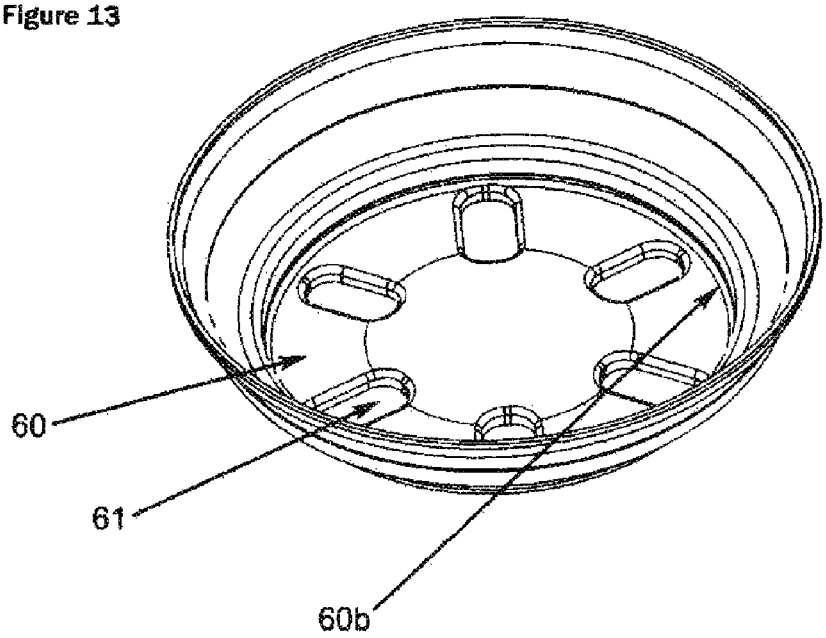
FIG. 13 is a top perspective view of the downturned sink and strainer cup.
Figure 14:
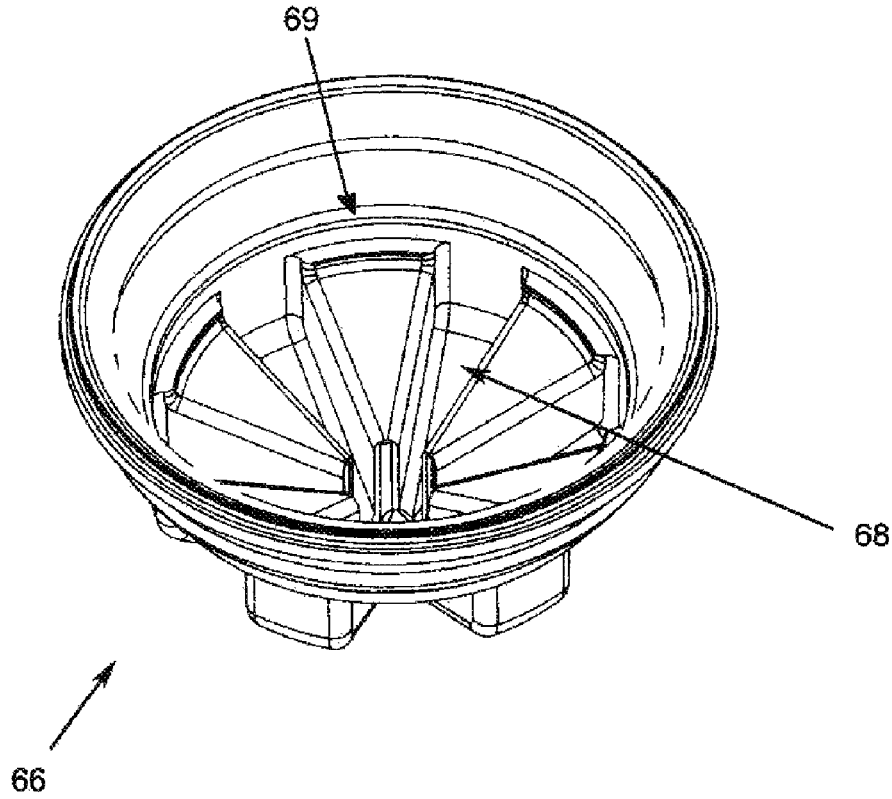
FIG. 14 is a top perspective view of the splashguard.

The dimensions of the strainer cup 60 are similar to the topside dimensions of the splashguard 66 FIG. 12, 14. This allows for the legs 62 to rest on top of the splashguard 66 to drain. The splashguard 66 has holes 68 FIG. 12, 14 or indents that allow the legs 62 to descend through. This allows the oversized seal 63 FIG. 12 to engage the oversized splashguard seat 69 FIG. 12, 14 of the splashguard 66 to fill the sink.

A variety of methods may be employed allowing a strainer basket to seal a splashguard. These include spaced protrusions on the inside wall of the splashguard that allow plastic or metal fingers extending laterally from the bottom of the strainer basket to rest on the protrusions. This holds the strainer basket with a fixed, oversized strainer seal in the open position. Rotating the strainer basket allows the fingers to slip into matching indents allowing the strainer, fingers, and seal to slide down as one piece past the protrusions into the splashguard engaging the oversized seal in the splashguard seat. The oversized seal may be of any design that facilitates a watertight fit and will probably be made of rubber, but may be made of silicon, or plastic or other pliable material. The strainer basket fingers may also be used to seal the splashguard by creating a watertight seal as the fingers descend into matching contours on the rubber splashguard. Another configuration is extending and resting the strainer basket's upper lips onto the sink bottom 2 FIG. 11. The strainer basket, hanging secure, has an oversized seal that may be mechanically lowered to seal both the strainer assembly and splashguard. Both the strainer assembly and splashguard surfaces have oversized seats to accept the oversized seal. In another configuration, the spaced protrusions on the splashguard may be coordinated with the strainer basket bottom to allow the strainer basket bottom to rest on the protrusions keeping the seal open. Firmly pushing down on the strainer basket handle forces the strainer basket to slide past the protrusions until the oversized seal is engaged with the splashguard seat.

Any of these integrated strainer/splashguard assemblies with oversized seals may be adopted for use with conventional splashguards and strainer assemblies. The strainer assembly cup walls 70 FIG. 11 would extend up and flare out to form a conventional flange that rests on the sink bottom 2. The assembly could then be mounted in a variety of established ways. Threads on the outside wall of the strainer bottom, threads on the outside wall of the strainer cup, threads on the drain fitting, or a hollow or solid bolt through the center of the strainer assembly could be used to sandwich a mounting cup as is currently the practice. Any design that secures the strainer cup with extended flange is acceptable. The splashguard concept can be easily adopted for conventional use by contouring the outside wall of the splashguard 66 to match the conventional disposer flange and sleeve.

The invention claimed is:

1. A sink drain assembly connectable to a lip disposed on one of a group comprising a garbage disposer and a strainer base member, said sink drain assembly comprising:

a sink having an opening in a bottom portion thereof, said opening being defined by a generally cylindrical drain sleeve integrally formed from and continuous with said bottom portion, said drain sleeve having a flange adjacent to an outer end thereof;

a resilient mounting member having a generally cylindrical interior surface formed with spaced apart upper and lower channels, said mounting member removably receiving said flange on said drain sleeve in said upper channel and said lip on said garbage disposer or strainer base member in said lower channel; and a clamp removably attached to the mounting member in overlying relation to the upper and lower channels, said clamp securing the mounting member to the drain sleeve and to the garbage disposer or strainer base member.

2. The sink drain assembly according to claim 1, further comprising fluid tight seals established between said mounting member and said drain sleeve and between said mounting member and said garbage disposer or the strainer base member by attaching the clamp to said mounting member.

3. The sink drain assembly according to claim 1, wherein said drain sleeve supports said mounting member and said garbage disposer or said strainer base member by attaching said clamp to said mounting member.

4. The sink drain assembly according to claim 1, wherein said clamp conforms to the shape of said mounting member by attaching said clamp to said mounting member.

5. The sink drain assembly according to claim 1, wherein an upper portion of said mounting member projects above said upper channel therein and conforms to a surface portion of said drain sleeve disposed between said undersurface of said sink and said flange thereon by attaching said clamp to said mounting member.

6. The sink drain assembly according to claim 1, wherein a lower portion of said mounting member projects below said lower channel therein and conforms to a surface portion of said garbage disposer or said strainer base member below said lip thereof by attaching said clamp to said mounting member.

7. The sink drain assembly according to claim 1, wherein said clamp overlies said upper and lower channels of said mounting member.

8. The sink drain assembly according to claim 1 further comprising a concave cup mounted in said strainer base member, said concave cup having a radially inwardly projecting gasket-receiving, annular seat.

9. The sink drain assembly according to claim 1 further comprising a concave splashguard mounted in said garbage disposer, said concave splashguard having a radially inwardly projecting gasket-receiving, annular seat.

10. The sink drain assembly according to claim 8 further comprising a strainer basket mountable in the concave cup , said strainer basket having an annular gasket disposed to engage the gasket-receiving, annual seat on the concave cup.

11. The sink drain assembly according to claim 9 further comprising a strainer basket mountable in the splashguard, said strainer basket having an annular gasket disposed to engage the gasket-receiving, annual seat on the splashguard.

* * * * *